United States Patent [19]

Onishi et al.

[11] Patent Number: 4,516,610

[45] Date of Patent: May 14, 1985

[54] WEFT PICKING DEVICE OF AIR JET WEAVING LOOM

[75] Inventors: Kimimasa Onishi; Takao Takahashi, both of Hachioji; Masayuki Koriyama, Tokyo, all of Japan

[73] Assignee: Nissan Motor Co., Ltd., Yokohama, Japan

[21] Appl. No.: 519,396

[22] Filed: Aug. 1, 1983

[30] Foreign Application Priority Data

| | | | |
|---|---|---|---|
| Aug. 4, 1982 | [JP] | Japan | 57-135095 |
| Mar. 29, 1983 | [JP] | Japan | 58-51463 |
| Mar. 29, 1983 | [JP] | Japan | 58-51464 |
| May 24, 1983 | [JP] | Japan | 58-91173 |

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 4,344,465 8/1982 Hasegawa et al. .

FOREIGN PATENT DOCUMENTS 2212455 7/1974 France ..... 139/435
27218 6/1982 Japan .
54040 3/1983 Japan .
WO82/03877 11/1982 PCT Int'l Appl. ..... 139/435

*Primary Examiner*—Henry S. Jaudon
*Attorney, Agent, or Firm*—Schwartz, Jeffery, Schwaab, Mack, Blumenthal & Koch

[57] ABSTRACT

An air guide member has therein an air guide opening and a slit through which the weft thread passes out of the opening. The opening has an inwardly projected land portion with first and second peripheral sides and includes an air induction section directly connected to the slit and a weft guiding section connected through the air induction section to the slit. The first peripheral side bounds partially the air induction section, while, the second peripheral side bounds partially the weft guiding section. An auxiliary nozzle is associated with one of the air guide members and has an air jet opening exposed to the air induction section so that the air jet from the opening advances toward the weft guiding section after passing through the air induction section. The opening is inclined toward the weft picking direction by a given angle with respect to the direction. An imaginary plane containing the second peripheral side of the land portion intersects the perimeter of the weft guiding section at a position away from the slit.

22 Claims, 21 Drawing Figures

WEFT PICKING DEVICE OF AIR JET WEAVING LOOM

BACKGROUND OF THE INVENTION

1. Field of the Invention

The present invention relates in general to a weft picking device of an air jet type weaving loom, and particularly to a weft picking device of the type comprising a row of air guide members, a main nozzle, and auxiliary nozzles associated with some of the air guide members to assist the weft picking operation. More particularly, the present invention is concerned with an improvement in the auxiliary nozzle-mounted air guide member of such type weft picking device.

2. Description of the Prior Art

In air jet type weaving looms, there is known a weft picking device of the type which comprises a row of closed type air guide members by which the weft carrying air guide channel is defined, a main nozzle by which the weft thread is ejected into the air guide channel, and auxiliary nozzles which are associated with some of the air guide members to eject auxiliary air into the air guide channel to assist the weft picking operation mainly effected by the main nozzle. Each of the air guide members employed in such device has therein an air guide opening forming a part of the air guide channel, and a slit forming a part of an axially extending slot formed in the row of the air guide members. Upon beating, the picked weft thread in the air guide channel passes out of the air guide channel through the slot.

In the air jet type weaving looms, it is important but difficult to continuously carry out perfect weft picking throughout the weaving operation of the loom, in order to produce a high quality or flawless woven fabric. However, some of the conventional weft picking devices hitherto developed have sometimes suffered from a so-called weft escaping phenomenon, in that under the weft picking operation, the weft thread running in the air guide channel would pass out of the channel through the slot of the air guide members by a drawing action of the leaked air flowing through the slot. In order to solve this undesired phenomenon, various attempts have been hitherto made without satisfactory results.

SUMMARY OF THE INVENTION

It is therefore an essential object of the present invention to provide a weft picking device which can solve or at least reduce the above-mentioned problem encountered in the conventional weft picking devices.

According to the present invention, there is provided a weft picking device of an air jet type weaving loom which comprises a plurality of air guide members which are aligned in the weft picking direction, each guide member having therein an air guide opening and a slit through which the weft thread passes out of the opening upon beating operation of the loom, the air guide opening having an inwardly projected land portion with first and second peripheral sides and including an air induction section directly connected to the slit and a weft guiding section connected through the air induction section to the slit, the first peripheral side of the land portion bounding partially the air induction section, while, the second peripheral side of the land portion bounding partially the weft guiding section; and an auxiliary nozzle associated with one of the air guide members, the nozzle having an air jet opening exposed directly to the air induction section so that jet air from the opening advances toward the weft guiding section after passing through the air induction section, the opening being inclined toward the weft picking direction by a given angle with respect to the direction, wherein an imaginary plane containing the second peripheral side of the inwardly projected land portion intersects the perimeter of the weft guiding section at a position away from the slit.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
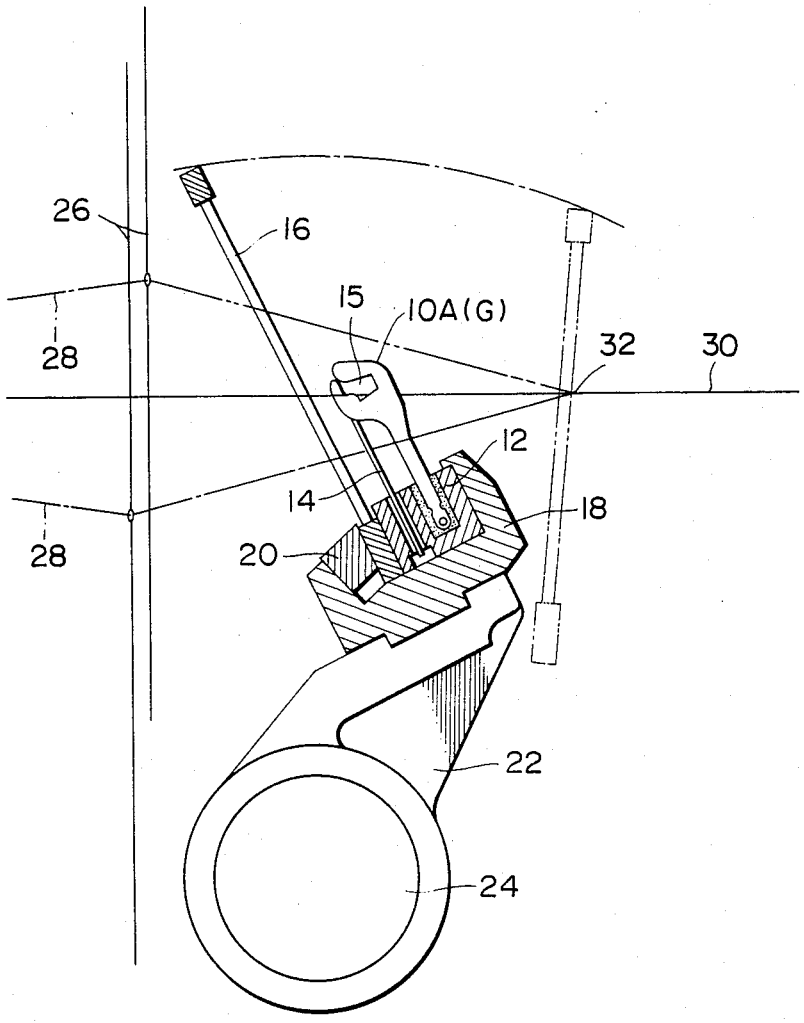
FIG. 1 is a sectional view of a first embodiment of a weft picking device according to the present invention in cooperation with an air jet weaving loom.
Figure 2:
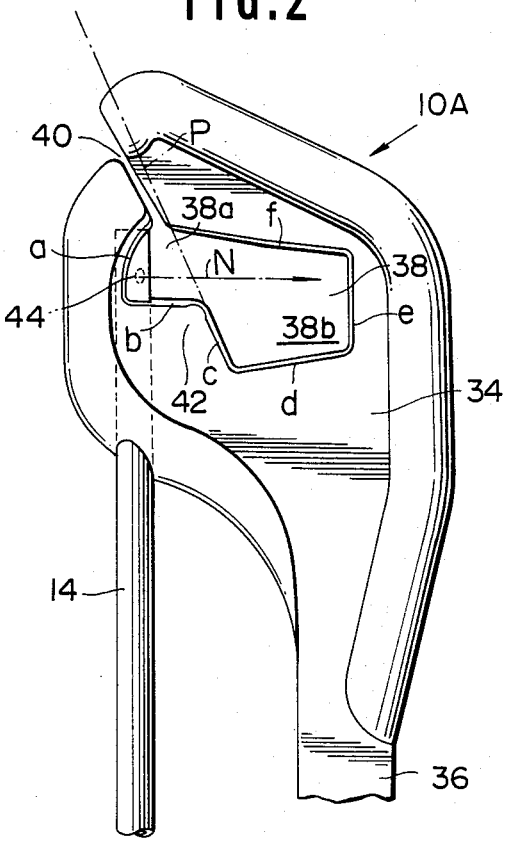
FIG. 2 is a side view of an auxiliary nozzle-mounted air guide member employed in the first embodiment.
Figure 3:
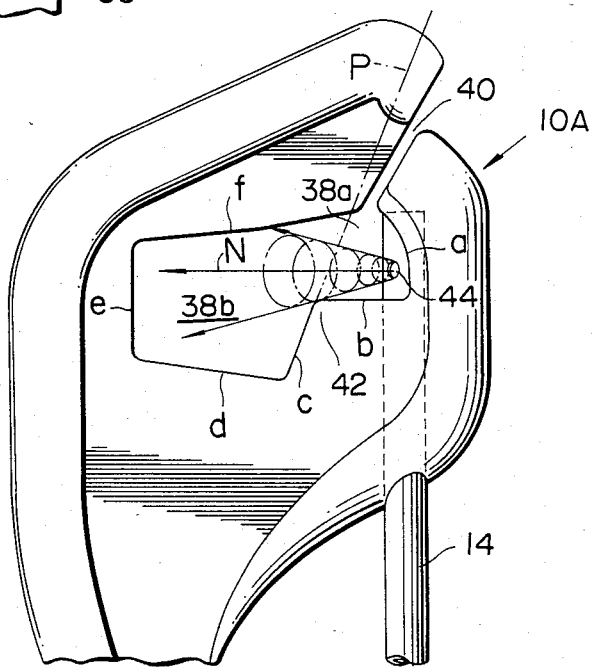
FIG. 3 is an enlarged fragmentary side view of the essential part of FIG. 2, but being taken from the direction opposite to FIG. 2.
Figure 4:
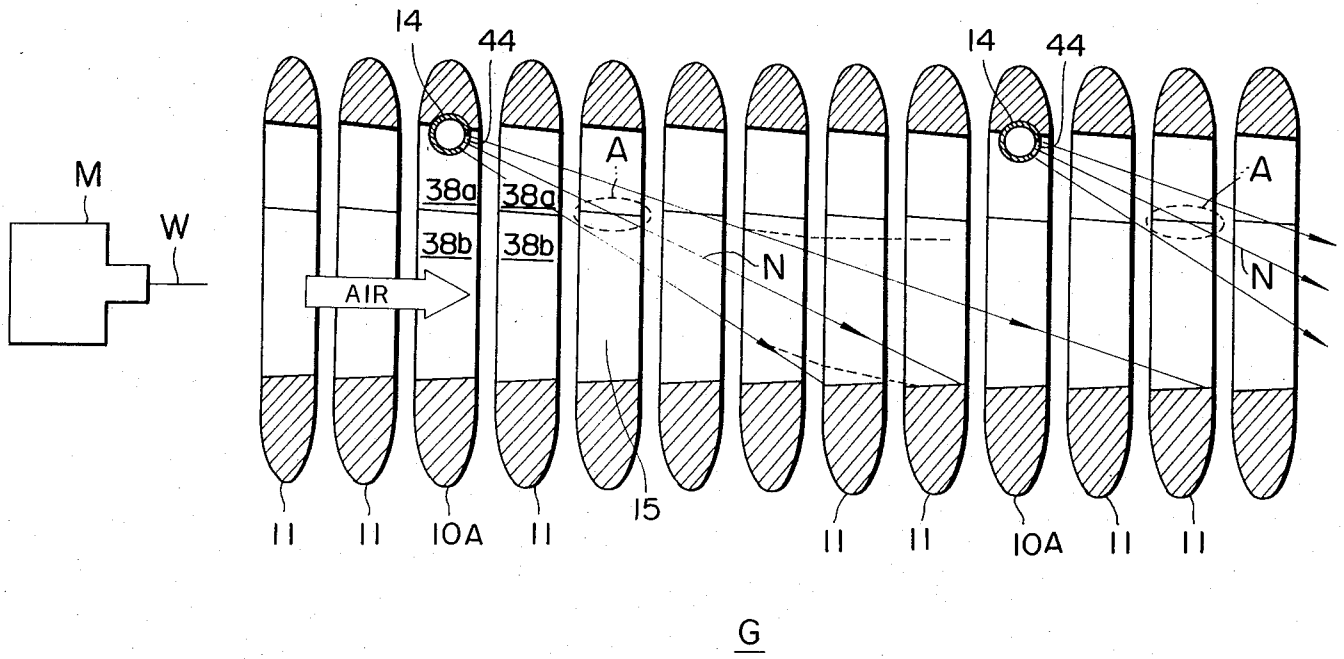
FIG. 4 is a horizontal sectional view of a row of air guide members some of which are those of the type shown in FIG. 2.

Referring to FIGS. 1 to 4, especially FIG. 1, there is shown a first embodiment of the weft picking device according to the present invention. In FIG. 1, a row of air guide members are designated by reference G, which are bonded at their leg portions to a mounting block 12. As is seen from FIG. 4, some 10A of the aligned air guide members are equipped with respective auxiliary nozzles 14, one of which is shown in FIG. 1. But, the other guide members 11 are not provided with such nozzles. As will be described in detail hereinafter, under the weft picking condition of the loom, the auxiliary nozzles 14 eject auxiliary air to the air guide channel 15 formed by the aligned guide members G, for assisting the weft carrying operation mainly effected by a main air jet nozzle M. Each auxiliary nozzle 14 is bonded at its leg portion to the mounting block 12 in the vicinity of the associated guide member 10A. The mounting block 12 and a reed 16 are securely mounted on a reed holder 18 by the aid of a wedge 20. The reed holder 18 is detachably mounted on a slay sword 22 to be pivotally movable therewith about the axis of a slay sword shaft 24. Near the upstream portion of the reed 16, there are arranged heddles 26 by which the warp threads 28 are handled to form a shed thereof. Designated by numeral 30 is a woven fabric which has the fell 32 at its rearmost section. Although not shown in FIG. 1, the main air jet nozzle is arranged at this side with respect to the face of FIG. 1 for picking the weft thread into the air guide channel 15 by the aid of the air jet ejected therefrom, as seen in FIG. 4. It is to be noted that in the description and claims, the terms "forward" and "rearward" are to be understood as "downstream" and "upstream" with respect to the motion of the woven fabric 30.

Referring to FIG. 2, there is shown in detail the auxiliary nozzle-mounted air guide member 10A, which comprises generally a guide member proper and the auxiliary nozzle 14. The guide member proper includes an enlarged generally flat top section 34 and an elongate leg section 36 which are integral with each other. The flat top section 34 is formed with an air guide opening 38 and a slit 40 through which the weft thread (not shown) passes out of the opening 38 upon beating operation of the loom. The air guide opening 38 is tapered toward the weft picking direction and has an inwardly projected land portion 42 so that the air guide opening 38 is of a generally hexagonal shape difined by six tapered sides a, b, c, d, e and f, as shown. The air guide opening 38 comprises an air induction section 38*a* which is located on the land portion 42 and directly connected to the slit 40, and a weft guiding section 38*b* which is located beside the land portion 42 and connected through the air induction section 38*a* to the slit 40. In other words, the air induction section 38*a* is positioned between the weft guiding section 38*b* and the slit 40. The weft guiding section 38*b* faces the main air jet nozzle (see FIG. 4) at least when the loom is under the weft picking condition. (Some of the air jet looms now in use are of a type wherein the main air jet nozzle is mounted on one axial end of the reed holder 18). The size of the weft guiding section 38*b* is larger than that of the air induction section 38*a*. In the illustrated example, the air induction section 38*a* is bounded, but partially, by the curved tapered side a and the flat tapered side b, while, the weft guiding section 38*b* is bounded, but partially, by the flat tapered sides c, d, e and f. If desired, the side f may be slightly curved upward at its middle section, as shown. The auxiliary nozzle 14 is embedded at its upper section in the flat top section 34 of the guide member proper with a portion thereof exposed to the air induction section 38*a*. As will be understood from FIG. 4, a nozzle opening 44 is formed in said exposed portion of the nozzle 14 and is inclined by a certain angle toward the weft picking direction. The arrow denoted by reference N is a so-called air injection direction line along which the major jet air from the nozzle opening 44 advances.

In the air guide member 10A as described hereinabove, the form and the position of the inwardly projected land portion 42 relative to the air guide opening 38 and the slit 40 are important in preventing the above-mentioned undesired weft escaping phenomenon. That is, they are so formed and arranged that an imaginary plane P containing the tapered flat surface of the side c of the weft guiding section 38*b* intersects the upper-positioned tapered flat side f of the same at a position away from the slit 40. In other words, the imaginary plane P does not intersects the slit 40, nor the curved tapered side a of the air induction section 38*a*.

As will be seen from FIG. 4, the other air guide member 11 which is a so-called "auxiliary nozzle-less air guide member" has substantially the same construction as the above-memtioned air guide member 10A except for the auxiliary nozzle 14. Of course, the auxiliary nozzle-less air guide member has the above-mentioned constructional feature applied to the guide member proper of the auxiliary nozzle-mounted air guide member 10A.

Upon assembly of the air guide members 10A and 11 on the mounting block 12, the auxiliary nozzle-mounted guide members 10A are arranged at predetermined intervals in the row G of the air guide members 10A and 11, as is seen in FIG. 4. Each of the air guide members is so oriented that the reduced section of the tapered air guide opening 38 thereof is directed toward the weft picking direction.

In the following, the operation of the first embodiment will be described with reference to FIGS. 3 and 4.

As is understood from FIG. 4, when the loom is under weft picking condition, the main nozzle M ejects air into the air guide channel 15 formed by the weft guiding sections 38*b* of the guide members 10A and 11, and at the same time, the auxiliary nozzles 14 eject auxiliary air downstream in a direction angled with respect to the weft picking direction. With these air ejections, the air stream running in the air guide channel 15 shows its maximum speed at or at least in the vicinity of the boundary portion A between the weft guiding section 38*b* and the air induction section 38*a*, because of the speed accelerating action applied by the air jet from each auxiliary nozzle 14 to the air stream. It has been revealed that the provision of such maximum speed area at the boundary portion A prevents the weft thread W, being picked, from getting into the air induction section 38*a*. Thus, usually, the weft thread W, ejected from the main air jet nozzle M, is forced to run within the air guide channel 15 defined by the weft guiding sections 38*b* even when it swings in all directions during its running therethrough. In fact, it has been revealed that during its running in the channel 15, the weft thread W vibrates and spirally turns about the axis of the air stream by which the weft thread W is carried, contacting sometime with the side c. However, in the embodiment of the present invention, since the tapered flat surface of the side c is directed toward the upper-positioned tapered flat side f away from the slit 40, the contact of the weft thread W with the side c does not force the weft thread W to shift or move toward the slit 40. Thus, in the invention, the undesired weft thread escaping phenomenon is much move effectively prevented.

Figure 5:
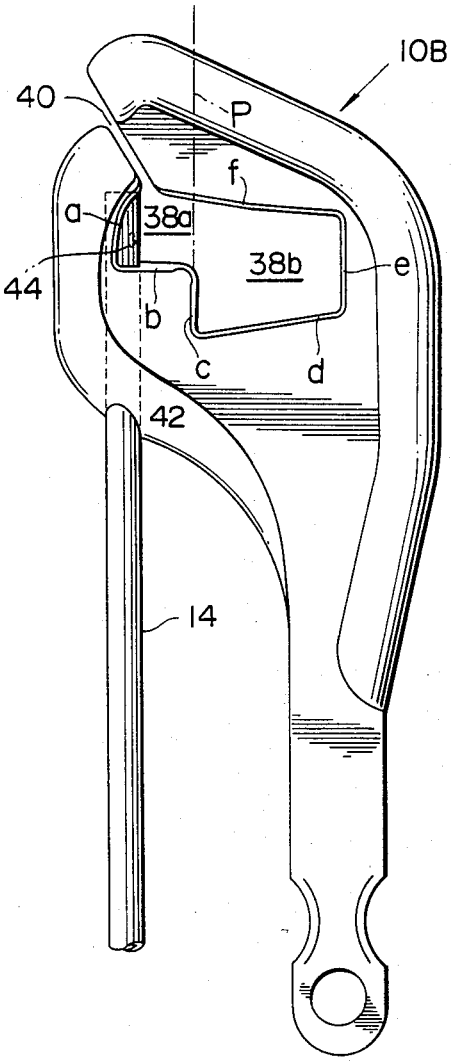
FIG. 5 is a view similar to FIG. 2, but showing an auxiliary nozzle-mounted air guide member employed in a second embodiment of the present invention.

Referring to FIG. 5, there is shown an auxiliary nozzle-mounted air guide member 10B employed in a second embodiment of the present invention. In this second embodiment, the side b and the side c intersect perpendicularly to each other so that the imaginary plane P of the side c intersects the side f at a position far away from the slit 40. Of course, the auxiliary nozzleless-air guide member (not shown) employed in this second embodiment has substantially the same construction as the guide member 10B except for the auxiliary nozzle 14.

Figure 6:
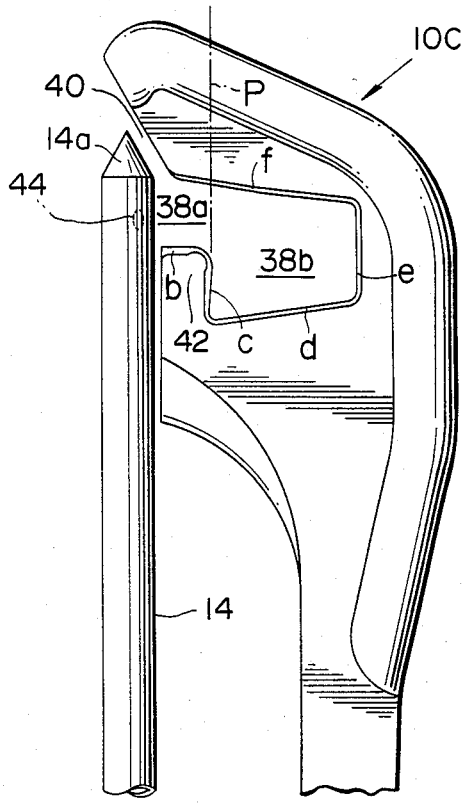
FIG. 6 is a view also similar to FIG. 2, but showing an auxiliary nozzle-coupled air guide member employed in a third embodiment of the present invention.

Referring to FIG. 6, there is shown an air guide member 10C and a separate auxiliary nozzle 14 which are employed in a third embodiment of the present invention. As shown in the drawing, the air guide member 10C has substantially the same construction as the above-mentioned air guide member 10B (FIG. 5) with the exception that the upwardly extending arm-like portion, which closes the air guide opening 38, is omitted. The separate auxiliary nozzle 14 is arranged, beside the air guide member 10C in a manner to close the air guide opening 38. The conical head portion 14*a* of the nozzle 14 is positioned close to the inclined side portion of the air guide member 10C thereby to form therebetween a slit 40 through which the weft thread passes out of the opening 38. Of course, the other air guide members employed in this third embodiment have each substantially the same construction as the guide member 10B except for the auxiliary nozzle 14 (see FIG. 5). The auxiliary nozzle-coupled air guide members 10C are arranged at predetermined intervals in the row G of the air guide members mounted on the reed holder 18.

Figure 7:
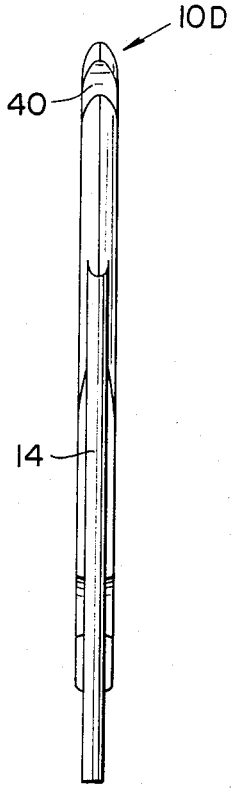
FIGS. 7(A) and 7(B) are respective front and side views of an auxiliary nozzle-mounted air guide member employed in a fourth embodiment of the present invention.
Figure 7:
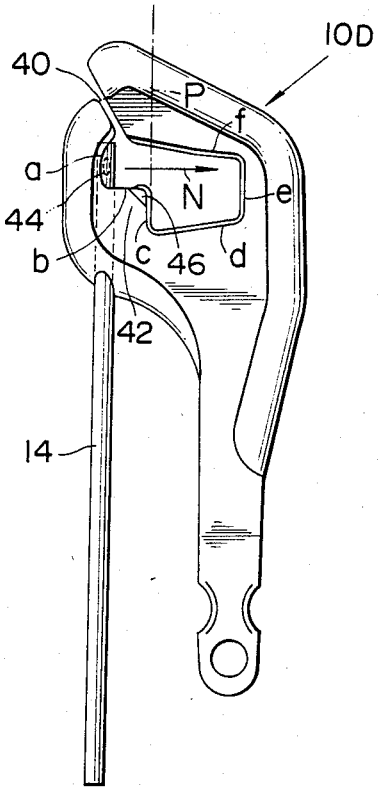
Figure 8:
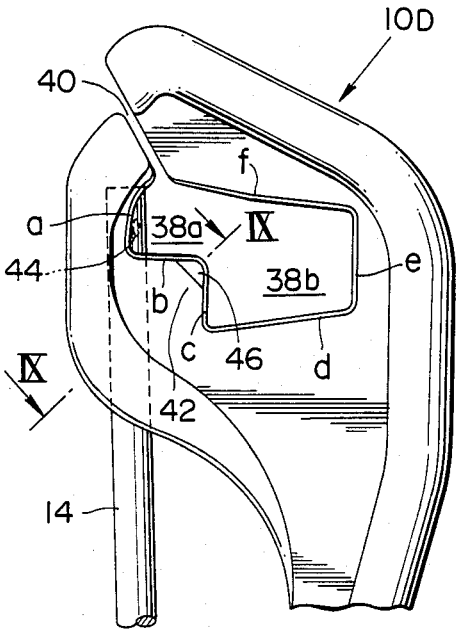
FIG. 8 is an enlarged fragmentary side view of the essential part of FIG. 7(B)
Figure 10:
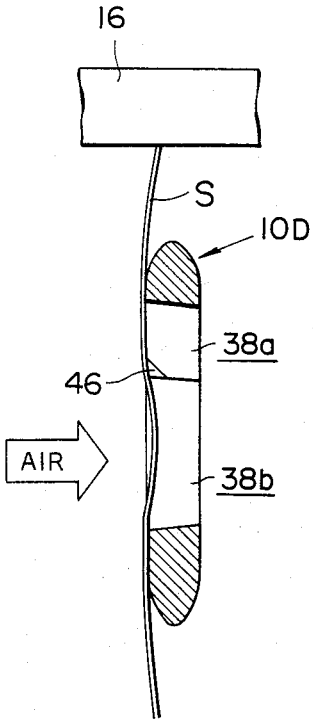
FIG. 10 is a horizontal sectional view of the air guide member of FIGS. 7(A) and 7(B)
Figure 9:
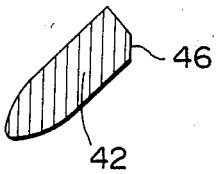
FIG. 9 is a sectional view taken along the line IX—IX of FIG. 8.
Figure 11:
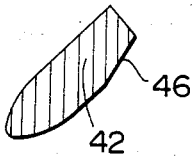
FIG. 11 is a view similar to FIG. 9, but showing a slight modification of the air guide member employed in the fourth embodiment.

Referring to FIGS. 7(A), 7(B), 8, 9 and 10 especially FIG. 7(B), there is shown an auxiliary nozzle-mounted air guide member 10D employed in a fourth embodiment of the present invention. The air guide member 10D of this fourth embodiment is substantially the same in construction as the guide member 10A or 10B of the afore-mentioned first or second embodiment, except for the construction of the inwardly projected land portion 42. As will be seen from FIGS. 8 and 9, the top section 46 of the land portion 42 is chamfered at the upstream side thereof with respect to the weft picking direction. If desired, as is seen from FIG. 11, the chamfer may be widely made. Furthermore, the chamfer may be flat or curved.

The fourth embodiment of the present invention possesses a marked advantage in addition to the above-mentioned advantages applied to the weft thread W. The additional advantage is applied to the warp threads and will become apparent from the following description which is made on the operation of the loom with reference to FIG. 10.

After beating by the reed 16, the row G of the air guide members 10D intrudes into the shed pushing their ways through the warp threads S. (See FIG. 1) During this operation, about ten or so warp threads S are compelled to pass through each clearance defined between adjacent two air guide members 10D. However, since this clearance is very small, usually less than 1 mm, the warp threads S or 28 in the clearance are forced to contact each other thereby causing some of the threads S to be brought into contact or abutment with the upstream portion of the air guide member 10D. This contact phenomenon becomes more conspicuous when the pre-jet action is carried out by the main air jet nozzle M because in this case the warp threads S crossing the air guide channel 15 are forced toward the weft picking direction by the air jet from the nozzle M, as is seen from FIG. 10. Furthermore, the vibration produced under operation of the loom makes the warp contact phenomenon much more conspicuous. Thus, if the inwardly projected land portion 42 is not chamfered at its top section, there is a possibility that one or some of the warp threads S in the clearance will be caught or hooked by the top section of the land portion 42 during the ingress or egress motion of the air guide members from the warp shed. This may cause breakage of the warp threads S. However, in the fourth embodiment, the undesirable warp contact phenomenon does not occur is at least reduced because of the provision of the chamfered top section 46 on the land portion 42.

Figure 12:
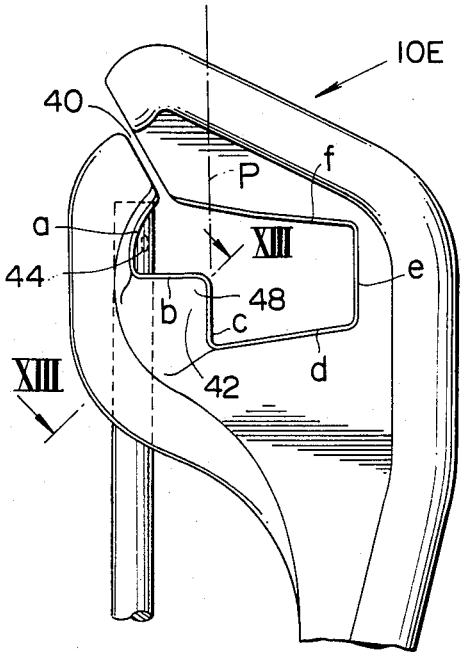
FIG. 12 is a view similar to FIG. 8, but showing an auxiliary nozzle-mounted air guide member employed in a fifth embodiment of the present invention.
Figure 13:
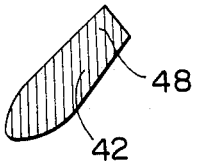
FIG. 13 is a sectional view taken along the line XIII—XIII of FIG. 12.

Referring to FIGS. 12 and 13, there is shown an auxiliary nozzle-mounted air guide member 10E employed in a fifth embodiment of the present invention. In this fifth embodiment, the top section 48 of much major or lower section of the same, as is seen in FIG. 13. Of course, the same advantageous function as the above-mentioned fourth embodiment is provided by this fifth embodiment.

Although, in the foregoing description on the first, second, third, fourth and fifth embodiments, the air guide opening 38 is described to be tapered, such taper is not always necessary in these embodiments.

Figure 14:
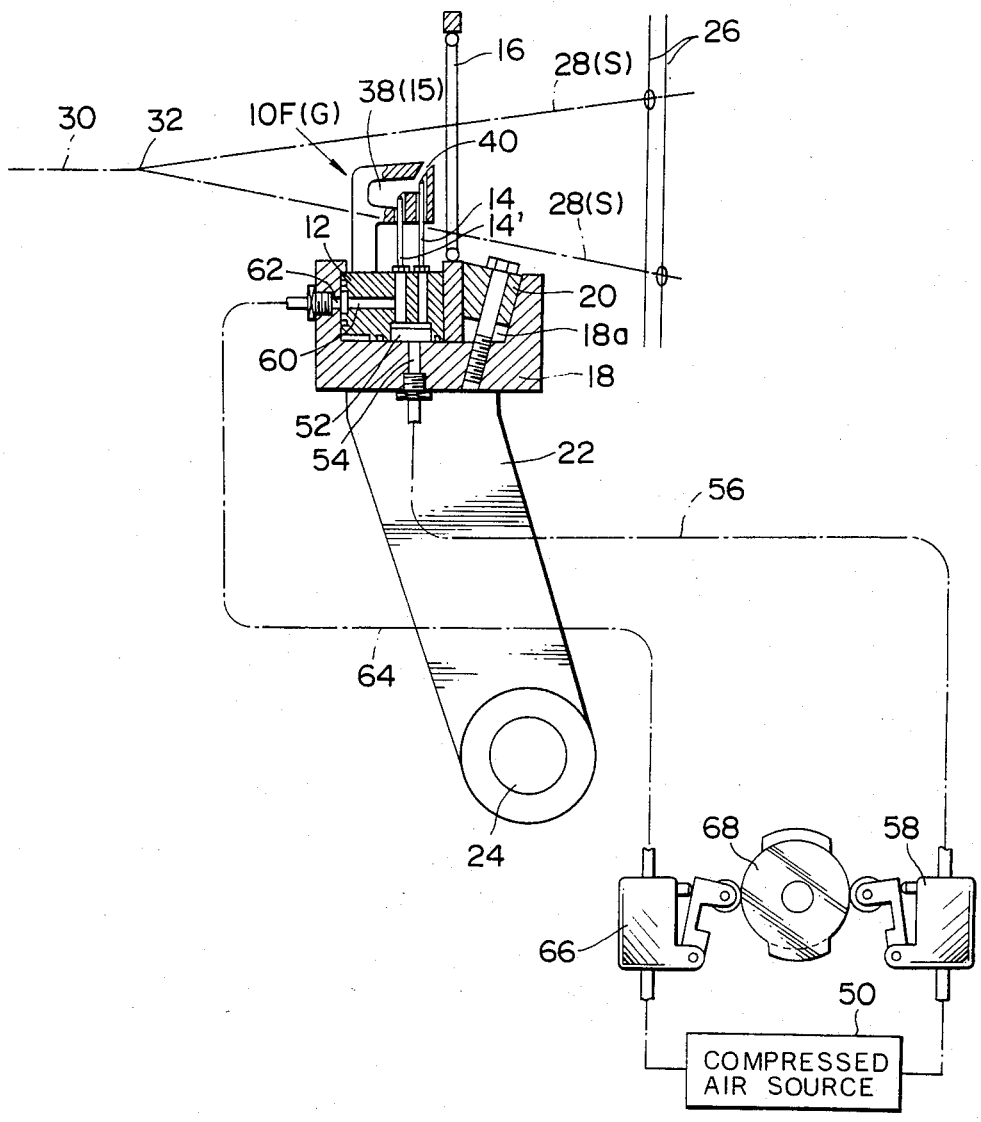
FIG. 14 is a sectional view of a sixth embodiment of a weft picking device of the present invention, in cooperation with an air jet type weaving loom.
Figure 15:
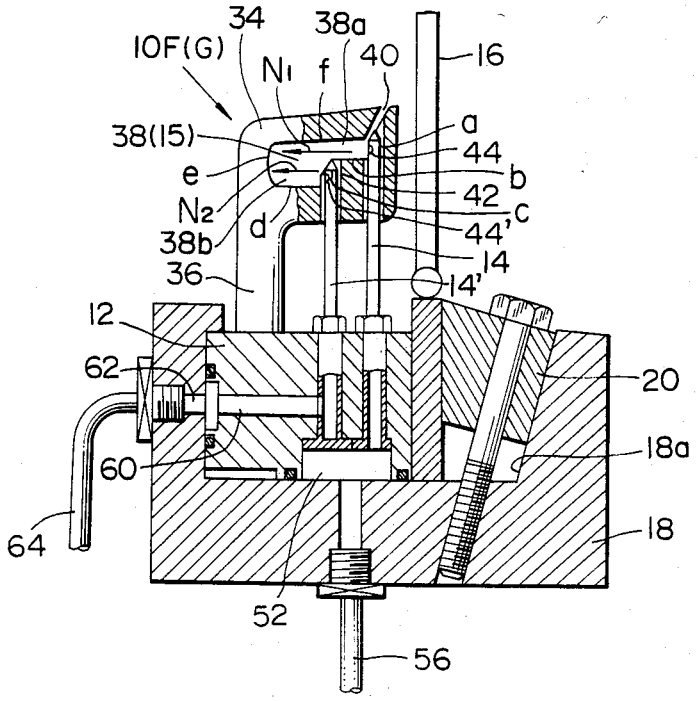
FIG. 15 is an enlarged fragmentary view of the essential part of FIG. 14.
Figure 16:
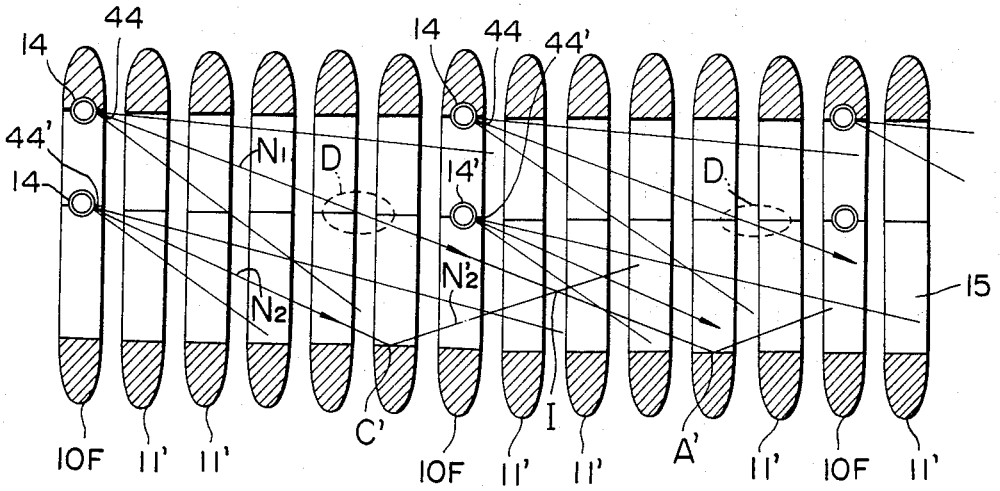
FIG. 16 is a horizontal sectional view of a row of air guide members employed in the sixth embodiment of FIG. 14.

Referring to FIGS. 14, 15 and 16, especially FIG. 14, there is shown a sixth embodiment of the weft picking device according to the present invention. In FIG. 14, a row of air guide members are designated by reference G, which are bonded at their leg portions to a mounting block 12. As is seen from FIG. 16, the aligned air guide members 10F are each equipped with two auxiliary nozzles 14 and 14', one of which is shown in FIG. 14. However, the other guide members 11' are not provided with such nozzles. The nozzles 14 and 14' are fixed at their leg portions to the mounting block 12 in the vicinity of the associated air guide member 10F. The mounting block 12 and a reed 16 are disposed in a groove 18*a* formed in the reed holder 18 and tightly fixed thereto by the aid of a wedge 20 which is bolted to the reed holder 18. The reed holder 18 is detachably mounted on a slay sword 22 to be pivotally movable therewith about the axis of a slay sword shaft 24. At the upstream portion of the reed 12, there are arranged heddles 26 by which the warp threads 28 are handled to form a shed thereof.

A woven fabric and a fell are designated by 30 and 32, respectively. Although not shown in FIG. 14, the main air jet nozzle is arranged at this side with respect to the face of FIG. 14 for picking the weft thread into the air guide channel 15 by the aid of the air jet ejected therefrom. The detailed construction and arrangement of each part will be described next.

As is best shown in FIG. 15, the auxiliary nozzle-mounted air guide member 10F employed in this sixth embodiment comprises generally a guide member proper, a first auxiliary nozzle 14 and a second auxiliary nozzle 14'. The guide member proper comprises an enlarged generally flat top section 34 and an elongate leg section 36. The flat top section 34 is formed with an air guide opening 38 and a slit 40 through which the weft thread (not shown) passes out of the opening 38 upon the beating operation of the loom. Similar to the afore-mentioned embodiments, the air guide opening 38 has an inwardly projected land portion 42 so that the guide opening 38 is of a generally hexagonal shape defined by six sides a, b, c, d, e and f, as shown.

The air guide opening 38 comprises an air induction section 38*a* which is located on the land portion 42 and directly connected to the slit 40, and a weft guiding section 38*b* which is located beside the land portion 42 and connected through the air induction section 38*a* to the slit 40. The weft guiding section 38*b* faces the main air jet nozzle (not shown) at least when the loom is under the weft picking condition. The size of the weft guiding section 38*b* is larger than that of the air induction section 38*a*. In the illustrated example, the air induction section 38*a* is bounded, but partially, by the sides a, b and f, while, the weft guiding section 38*b* is bounded, but partially, by the sides c, d, e and f. It is now to be noted that the side b and the side f are parallel with each other.

The first and second auxiliary nozzles 14 and 14' are mounted on the mounting block 12 using nuts (no numerals). The first auxiliary nozzle 14 is embedded at its upper section in the flat top section 34 of the guide member proper with a portion thereof exposed to the air induction section 38*a*, while, the second auxiliary nozzle 14 is embedded in the section 34 with a portion thereof exposed to the weft guiding section 38*b*. The exposed portions of these auxiliary nozzles 14 and 14' are respectively formed with nozzle openings 44 and 44'. As shown in FIG. 15, the opening 44 of the first auxiliary nozzle 14 is positioned near the boundary portion between the air induction section 38*a* and the slit 40 and faces toward the air induction section 38*a*. As is seen from FIG. 16, the opening 44 is oriented to incline by a certain angle toward the weft picking direction. The arrow denoted by reference $N_1$ is the air injection direction line along which the major air jet from the opening 44 advances. Thus, the jet air from the opening 44 reaches the upper zone of the weft guiding section 38*b*, after passing through the air induction section 38*a*, as is understood from FIG. 15. The opening 44' of the second auxiliary nozzle 14' is positioned near the boundary portion between the air induction section 38*a* and the weft guiding section 38*b* and faces toward the lower zone of the weft guiding section 38*b*. As is seen from FIG. 16, the opening 44' is oriented to incline by substantially the same angle as that of the opening 44 toward the weft picking direction. The arrow $N_2$ is the air injection direction line along which the major air jet from the opening 44' advances. Thus, the jet air from the opening 44' is directly applied to the lower zone of the weft guiding section 38*b*.

As will be seen from FIG. 16, the other air guide member 11' which is a so called "auxiliary nozzleless air guide member" has substantially the same construction as the above-mentioned air guide member 10F except for the first and second auxiliary nozzles 44 and 44''.

Upon assembly of the air guide members 10F and 11' on the mounting block 12, the auxiliary nozzle-mounted guide members 10F are arranged at predetermined intervals in the row G of the air guide members, as is seen in FIG. 16.

As is seen in FIG. 14, the first and second auxiliary nozzles 14 and 14' are connected to a compressed air source 50 through respective lines or tubes 56 and 64. The line for the first auxiliary nozzle 14 comprises a distributing groove 52 formed in the mounting block 12, a passage 54 formed in the reed holder 18, tube 56 and a valve 58. While, the line for the second auxiliary nozzle 14' comprises a passage 60 formed in the mounting block 12, a passage 62 formed in the reed holder 18, a tube 64 and a valve 66. The valves 58 and 66 are operated by a common cam 68 which rotates in response to the operation of the loom.

In the following, operation will be described with reference to FIG. 16.

Under the weft picking condition of the loom, the main nozzle (not shown) ejects air into the air guide channel 15 formed by the weft guiding sections 38*b* of the guide members 10F and 11', and the first and second auxiliary nozzles 14 and 14' eject air, in timed relation, downstream at a given angle with respect to the weft picking direction. With the air ejection from the first auxiliary nozzles 44, the air stream flowing in the air guide channel 15 shows its maximum speed at or at least in the vicinity of the boundary section D between the weft guiding section 38*b* and the air induction section 38*a*, because of the speed accelerating action applied by the air jet from each first auxiliary nozzle 14 applied to the air stream. Thus, by the same reason as that mentioned hereinafore, the weft thread W is forced to run within the air guide channel 15 defined by the weft guiding sections 38*b*, so that the undersired weft escaping phenomenon is prevented or at least reduced. Furthermore, the jet air from the secondary auxiliary nozzles 44', which is ejected toward the lower zone of the air guide channel 15, prevents occurence of undesired spiral flow of the jet air ejected from the first auxiliary nozzles 44. In fact, if the second auxiliary nozzles 44' are not provided, such spiral flow about the axis of the air guide channel 15 (in counterclockwise direction in FIG. 15) tends to occur because the first auxiliary nozzles 44 eject air toward only the upper zone of the channel 15, which spiral flow disturbs but slightly the main air stream running in the air guide channel 15. Thus, in this sixth embodiment, the provision of the auxiliary nozzles 44' serves a smoother flow of the main air stream in the channel 15. Thus, the weft thread escaping phenomenon is much more effectively prevented.

If desired, the size of the air jet opening 44 of the first auxiliary nozzle 14 may be made larger than that of the second auxiliary nozzle 14'.

If the compressed air supply lines are arranged so that the air ejection of the first auxiliary nozzles 44 is effected slightly before that of the second auxiliary nozzles 44' to cause the two air jets from these nozzles 44 and 44' to reach the air guide channel 15 at the same time, the flow of the main air stream becomes more stable.

Figure 17:
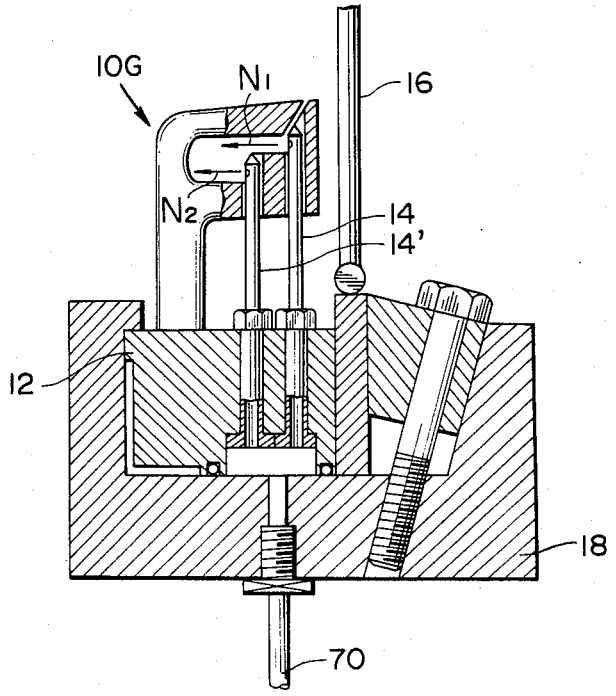
FIG. 17 is a view similar to FIG. 15, but showing a seventh embodiment of the present invention.

Referring to FIG. 17, there is shown an auxiliary nozzles-mounted air guide member 10G employed in a seventh embodiment of the present invention, which is a slight modification of the above-mentioned sixth embodiment. As will be understood from the drawing, the air supply to the nozzles 44 and 44' is made by a common air supply line 70 which is connected to the compressed air source. In this seventh embodiment, the air ejections of the first and second auxiliary nozzles 44 and 44' are effected at the same time, unlike the case of the sixth embodiment of FIG. 14.

Figure 20:
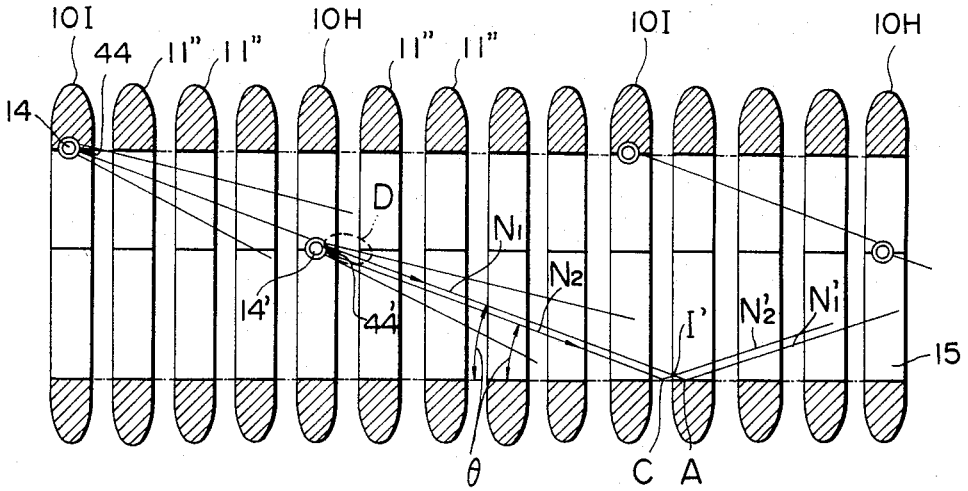
FIG. 20 is a horizontal sectional view of a row of the air guide members employed in the eighth embodimemt.
Figure 18:
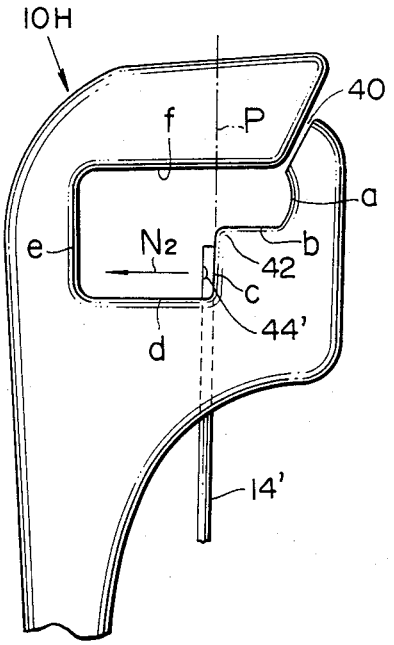
FIGS. 18 and 19 are side views of two auxiliary nozzle-mounted air guide members employed in an eighth embodiment of the present invention.
Figure 19:
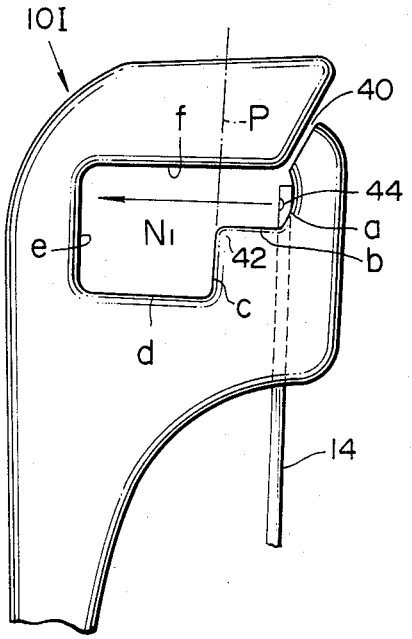

Referring to FIGS. 18, 19 and 20, especially FIGS. 18 and 19, there are shown two auxiliary nozzle-mounted air guide members 10H and 10I which are employed in an eighth embodiment of the present invention. It is to be noted that the guide member 10H has substantially the same construction as the above-mentioned air guide member 10F of the sixth embodiment except that it is not provided with the first auxiliary nozzle 14, while, the other guide member 10I has the substantially the same costruction as the air guide member 10F except that it is not provided with the second auxiliary nozzle 14'. Thus, description of the construction of these air guide members 10H and 10I will be omitted, but corresponding portions and parts to the guide member 10F are designated by the same numerals.

As will be understood from FIG. 20, the other air guide member 11'' which is a so-called auxiliary nozzle-less-air guide member has substantially the same construction as the air guide member 10H or 10I except for the auxiliary nozzle 14' or 14.

Upon assembly of these air guide members 10H, 10I and 11'' on the mounting block 12, the guide members 10H and 10I are arranged at predetermined intervals in the row G of the guide members, as is seen from FIG. 20. More specifically, in this eighth embodiment, between the adjacent two air guide members 10H and 10I, the following positional relationship is established. That is, the air guide member 10H is located at or at least near the position D where the air injection direction line $N_1$ of the opening 44 of the upstream positioned air guide member 10I reaches the air guide channel 15 defined by the weft guiding sections **38*b* of the aligned guide members 10I, 10H and 11''. As shown, the air injection direction line $N_1$ inclines at a predetermined angle $\theta$ with respect to the way of the picked weft thread in the air guide channel 15. In addition to this relationship, the opening 44' of the air guide member 10H is so oriented that the air injection direction line $N_2$ thereof inclines at the same angle $\theta$ as the line $N_1$ with respect the weft thread path in the channel 15. It is to be noted that the points A and C are the positions where the lines $N_1$ and $N_2$ intersect the inner forward surface of the air guide channel 15** of the air guide members respectively.

The eighth embodiment of the invention possesses a more advantageous function than the sixth embodiment. In order to clarify the marked advantage of this eighth embodiment, the following description will be made by comparing the phenomenon depicted by FIG. 20 of the eighth embodiment with that by FIG. 16 of the sixth embodiment.

In case of the sixth embodiment (see FIG. 16), the first and second auxiliary nozzles 14 and 14' are mounted on a common air guide member 10F with their air ejecting openings 44 and 44' located in vertically different positions. Thus, the points A' and C' corresponding to the above-mentioned points A and C of FIG. 20 are considerably distant from each other as compared with the case of the eighth embodiment of FIG. 20. Thus, in the sixth embodiment, the air injection direction line $N_1$ of the opening 44 of the first auxiliary nozzle 14 intersects the reflected component $N_2'$ of the line $N_2$ of the opening 44' of the second auxiliary nozzle 14' at the point I which is the central area of the air guide channel 15 or at least in the vicinity of the same. This means that the air jets from the first and second auxiliary nozzles 14 and 14' collide with each other at the central area of the channel 15 or its near portion causing the weft carrying main air stream running along the channel 15 to be considerably disturbed by such auxiliary air jets. However, in the eighth embodiment (see FIG. 20), the point I' corresponding to the point I is located very near the inner surface area of the channel 15, that is, at a position away from the central area of the channels 15. Thus, the interference of such auxiliary air jets to the main air stream is quite small or negligible as compared with the case of the sixth embodiment.

Thus, in this eighth embodiment, the undesired weft thread escaping phenomenon is more effectively prevented.

If desired, the compressed air supply to the nozzles 14 and 14' may be so made that the air jet from the second auxiliary nozzle 14' is less in power than that from the first auxiliary nozzle 14, or the air jets from these two auxiliary nozzles 14 and 14' reach the central area of the air guide channel 15 at the same time. Furthermore, the size of the air jet opening 44 of the first auxiliary nozzle 14 may be made larger than that of the second auxiliary nozzle 14'. With these measures, the undesired weft escaping phnomenon is prevented.

What is claimed is:

1. A weft picking device of an air jet type weaving loom, comprising:

a plurality of air guide members which are aligned in the weft picking direction, each guide member having therein an air guide opening and a slit through which the weft thread passes out of the opening upon beating operation of the loom, said air guide opening having an inwardly projected land portion with first and second peripheral sides and including an air induction section directly connected to said slit and a weft guiding section connected through said air induction section to said slit, said first peripheral side of said land portion bounding partially said air induction section, while, said second peripheral side of said land portion bounding partially said weft guiding section; and an auxiliary nozzle associated with one of the air guide members, said nozzle having an air jet opening facing said air induction section so that jet air from said opening advances toward said weft guiding section after passing through said air induction section, the opening being inclined toward the weft picking direction by a given angle with respect to said direction, wherein an imaginary plane containing said second peripheral side of said inwardly projected land portion intersects the upper perimeter of said weft guiding section at a position spaced from said slit.

2. A weft picking device as claimed in claim 1, in which said weft guiding section of said air guide opening is larger than said air induction section of the same.

3. A weft picking device as claimed in claim 2, in which said first and second peripheral sides intersect perpendicularly each other so that said imaginary plane intersects said upper perimeter of the weft guiding section at a position spaced from said slit.

4. A weft picking device as claimed in claim 2, in which the top section of said inwardly projected land portion is chamfered at the upstream side thereof with respect to the weft picking direction.

5. A weft picking device as claimed in claim 4, in which the surface of the chamfered section is flat or curved.

6. A weft picking device as claimed in claim 2, thinner than the major section of the land portion.

7. A weft picking device as claimed in claim 2, in which said auxiliary nozzle is embedded at its upper section in said air guide member with said air jet opening exposed to said air induction section.

8. A weft picking device as claimed in claim 7, further comprising another auxiliary nozzle which has an air jet opening from which an air jet issues directly toward said weft guiding section of said air guide opening.

9. A weft picking device as claimed in claim 8, in which said another auxiliary nozzle is embedded at its upper section in said air guide member with a portion thereof exposed to said weft guiding section, the exposed portion being formed with the air jet opening of said another auxiliary nozzle, said air jet opening of said another auxiliary nozzle being inclined toward the weft picking direction by a given angle with respect to said direction.

10. A weft picking device as claimed in claim 8, in which said air jet opening of said another auxiliary nozzle is inclined by substantially the same angle as that of the afore-mentioned primary auxiliary nozzle.

11. A weft picking device as claimed in claim 10, in which the size of the air jet opening of said primary auxiliary nozzle is larger than that of said another auxiliary nozzle.

12. A weft picking device as claimed in claim 10, further comprising a compressed air supply means which is so arranged that the air ejection of the primary auxiliary nozzle is effected just before that of said another auxiliary nozzle so as to cause the air jets from the two air jet openings of these two auxiliary nozzles to reach said weft guide section of said air guide opening at the same time.

13. A weft picking device as claimed in claim 10, further comprising a compressed air supply means which supplies the two auxiliary nozzles with compressured air simultaneously.

14. A weft picking device as claimed in claim 8, in which said another auxiliary nozzle is embedded at its upper section in another air guide member with a portion thereof exposed to the weft guiding section of said another air guide member, the exposed portion being formed with the air jet opening of said another auxiliary nozzle, said another air guide member being arranged downstream of the afore-mentioned primary air guide member with respect to the weft picking direction.

15. A weft picking device as claimed in claim 14, in which the air jet opening of said another air guide member is located at or at least near the position where the air injection direction line of the air jet opening of said primary auxiliary nozzle reaches the air guide channel defined by the weft guiding sections of the aligned air guide members, said air injection direction line being a line along which the major air jet stream from said primary auxiliary nozzle advances.

16. A weft picking device as claimed in claim 15, in which said air jet opening of said another auxiliary nozzle is so oriented that the air injection direction line thereof inclines at the same angle $\theta$ as the air injection direction line of said primary auxiliary nozzle with respect to the major way along which the weft thread is picked in the air guide channel.

17. A weft picking device as claimed in claim 16, in which the size of the air jet opening of said primary auxiliary nozzle is larger than that of said another auxiliary nozzle.

18. A weft picking device as claimed in claim 2, in which said auxiliary nozzle is located beside the associated air guide member with said air jet opening facing toward said air induction section.

19. A weft picking device as claimed in claim 18, further comprising another auxiliary nozzle which has an air jet opening from which an air jet issues directly toward said weft guiding section of said air guide opening.

20. A weft picking device as claimed in claim 19, in which said another auxiliary nozzle is embedded at its upper section in said air guide member with a portion thereof exposed to said weft guiding section, the exposed portion being formed with the air jet opening of said another auxiliary nozzle, said air jet opening of said another auxiliary nozzle being inclined toward the weft picking direction by a given angle with respect to said direction.

21. A weft picking device as claimed in claim 19, in which said air jet opening of said another auxiliary nozzle is inclined by substantially the same angle as that of the afore-mentioned primary auxiliary nozzle.

22. A weft picking device as claimed in claim 19, in which said another auxiliary nozzle is embedded at its upper section in another air guide member with a portion thereof exposed to the weft guiding section of said another air guide member, the exposed portion being formed with the air jet opening of said another auxiliary nozzle, said another air guide member being arranged downstream of the afore-mentioned primary air guide member with respect to the weft picking direction.

* * * * *